US005765703A

United States Patent [19]

Shiwaku

[11] Patent Number: 5,765,703

[45] Date of Patent: Jun. 16, 1998

[54] OVERHEAD TRAVELLING CARRIAGE

[75] Inventor: Tamotsu Shiwaku, Kani, Japan

[73] Assignee: Murata Kikai Kabushiki Kaisha, Kyoto, Japan

[21] Appl. No.: 904,750

[22] Filed: Aug. 1, 1997

Related U.S. Application Data

[63] Continuation of Ser. No. 621,381, Mar. 25, 1996, abandoned.

[30] Foreign Application Priority Data

Apr. 27, 1995 [JP] Japan ..... 7-127190

[51] Int. Cl.[6] ..... B66C 13/06

[52] U.S. Cl. ..... 212/274; 254/278

[58] Field of Search ..... 212/274; 254/278

[56] References Cited

U.S. PATENT DOCUMENTS

| | | | |
|---|---|---|---|
| 505,064 | 9/1893 | Sawyer | 212/274 |
| 2,164,128 | 6/1939 | Medenwald | 212/274 |
| 2,752,120 | 6/1956 | Bogle | 212/274 |
| 4,883,184 | 11/1989 | Albus | 212/274 |
| 4,905,848 | 3/1990 | Skjonberg | 212/274 |
| 5,423,438 | 6/1995 | Swanson | 212/274 |

FOREIGN PATENT DOCUMENTS

| | | | |
|---|---|---|---|
| 1908293 | 9/1970 | Germany | 294/81.4 |

*Primary Examiner*—Thomas J. Brahan
*Attorney, Agent, or Firm*—Armstrong, Westerman, Hattori, McLeland & Naughton

[57] ABSTRACT

Three suspension points 20–22 are arranged in the shape of an equilateral triangle on a vertically movable table 16 and two cables 23–28 are attached to each. Three pairs of hoist members 10/11/12 are arranged on the main body 4, and each hoists a cable from two suspension points.

While preventing oscillation and twist of the vertically movable table and making guide poles unnecessary, high speed vertical rising and lowering is possible.

5 Claims, 5 Drawing Sheets

OVERHEAD TRAVELLING CARRIAGE

This application is a continuation of application Ser. No. 08/621,381 filed Mar. 25, 1996, now abandoned.

FIELD OF THE INVENTION

This invention relates to an overhead travelling carriage used for transportation of products at an industrial plant or warehouse, and in particular to a suspension device for a vertically movable table.

BACKGROUND OF THE INVENTION

Conventionally, an overhead travelling carriage has been known whose main body freely runs along a rail arranged near the ceiling of a building and which suspends a vertically movable table from the main body by ropes, belts or the like.

An example of this kind of overhead travelling carriage is shown in FIG. 5 with 01 being the rail, 02 being the main body, 03 being the wheels of the travelling carriage and 04 being a hoist roller. The vertically movable table 05 is suspended from the main body 02 at three or four points by the suspending members 06 and each suspending member 06 is parallel to one another and aligned pointing in the vertical direction. Work piece 07 is the transported object and is gripped by the vertically movable table 05 by hooks or vacuum pads (not shown in the drawing).

However, oscillation and twisting of the vertically movable table 05 readily occurs on this kind of overhead travelling carriage. As a result, gripping of the work piece 07 becomes unstable requiring the arrangement and coupling of guide poles 08,08 in the floor surface with guide holes 09 in the vertically movable table in order to regulate the positioning.

In addition, as oscillation and twisting easily occur, it is necessary to regulate the vertical moving speed of the vertically movable table 05.

Furthermore, apart from the devices with four suspension members 06, on a device with three suspension members 06, should one break, the work piece would fall. Even with four suspension members 06, if one breaks then the vertically moving table 05 would slant.

SUMMARY OF THE INVENTION

It is a primary object of the present invention to propose a vertically moving table with little oscillation or twisting, where no guide poles are necessary, where the vertically moving table can be vertically moved at high speed and finally, where even if there is damage to the cables, any slant of the vertically moving table is extremely small.

It is another object to propose positioning of three points of the vertically movable table for attachment to the cables at the three points of an equilateral triangle, thus reliably supporting the vertically movable table and, moreover, to enable hoisting of the six suspending members by three sets of hoist members.

It is yet another object of the present invention to change the hoisting position of the suspending members during vertical movement of the vertically movable table and restrict any increase in hoisting torque during that elevation, as well as more reliably preventing oscillation and twisting of the vertically movable table by restricting any reduction in angle between the suspending members during lowering.

On the overhead travelling carriage of this invention comprising the main body that moves along a rail affixed near the ceiling of a building and the vertically movable table which is suspended from that main body and is freely raisable, two suspending members are attached to each of three points on the top of said vertically movable table and, forming an angle between each of them, those suspending members are attached to the hoist member of the aforementioned main body.

The three points can be arranged in, for example, the three points of an isosceles triangle but it is preferable to position said three points on the three corners of an equilateral triangle. In addition, three pairs of said hoist members are arrannged on said main body and moreover, two cables are attached to each hoist member pair.

Further preferable is the construction where a screw shaped hoisting drum is arranged on said hoist member and the hoisted rope is stored in the screw grooves, the hoisting position of the cable seperates from the apices of said equilateral triangle by the lowering of the vertically movable table and approaches the vertex of said equilateral triangle by the raising of the vertically movable table.

An arrangement according to a first aspect of the present invention is the attachment of two cables to each of three points on the vertically movable table and suspension from the main body to generate an angle between each cable. If the vertically movable table attempts to twist, one cable is pulled and play is generated in the other attached to the same point. Due to this, there is great resistance to twisting and twisting can be prevented.

Also, if the vertically movable table attempts to oscillate, a large force is applied to one cable while play is generated in another thus preventing oscillation. As a result, twisting and oscillation of the vertically movable table is prevented and elevation can be carried out at high speed. There is no need for guide poles for reducing oscillation and twisting and as there are six cables, even if one is damaged there is little slanting of the vertically movable table.

Further, the vertically movable table is suspended by the arrangement of three suspension points of the vertically movable table in an approximate equilateral triangle and two cables are attached to each hoist member and the hoist members hoist up the vertically movable table.

Yet further, screw shaped hoisting drums are arranged on the hoist members and the hoisted cables are stored in the grooves of the screws. Due to this, the hoisting position of the cable changes in response to the hoisting and when the vertically movable table rises, the distance between the hoisting position of two cables attached to the same point decreases and increases as the vertically movable table drops.

DERAILED DESCRIPTION OF THE PREFERRED EMBODIMENT

FIGS. 1 through 6 show the embodiment and it's modifications.

Figure 1:
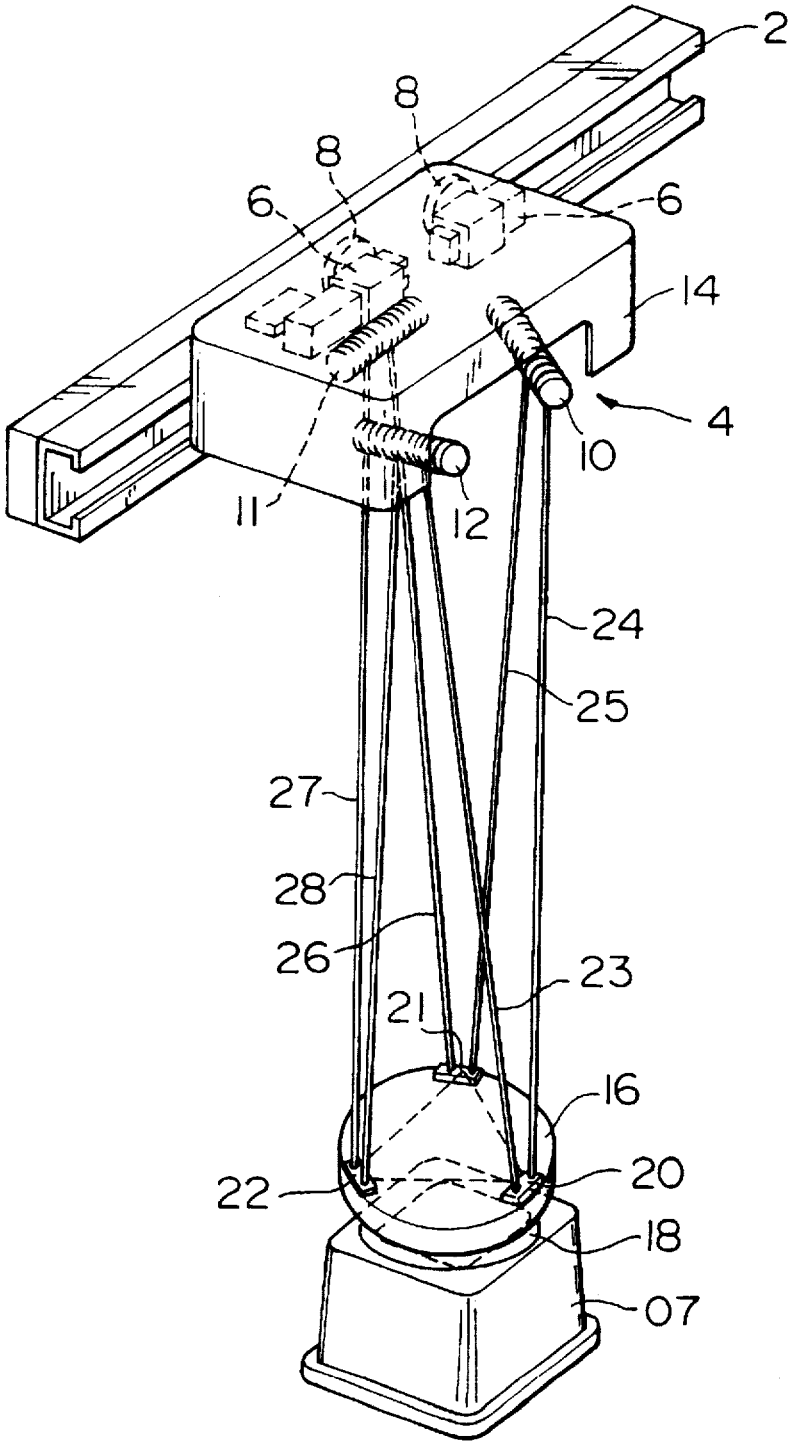
FIG. 1 is a perspective view of the embodied overhead travelling carriage.

In FIG. 1, 2 is a rail arranged along the ceiling of the industrial plant, warehouse or the like, 4 is an overhead travelling carriage mainbody and is controlled for example by a signal from the rail 2 by radio induction communication. One pair of travelling motors 6,6 and wheels 8,8 are arranged for example on main body 4 which enable it to run along the rail 2.

Figure 2:
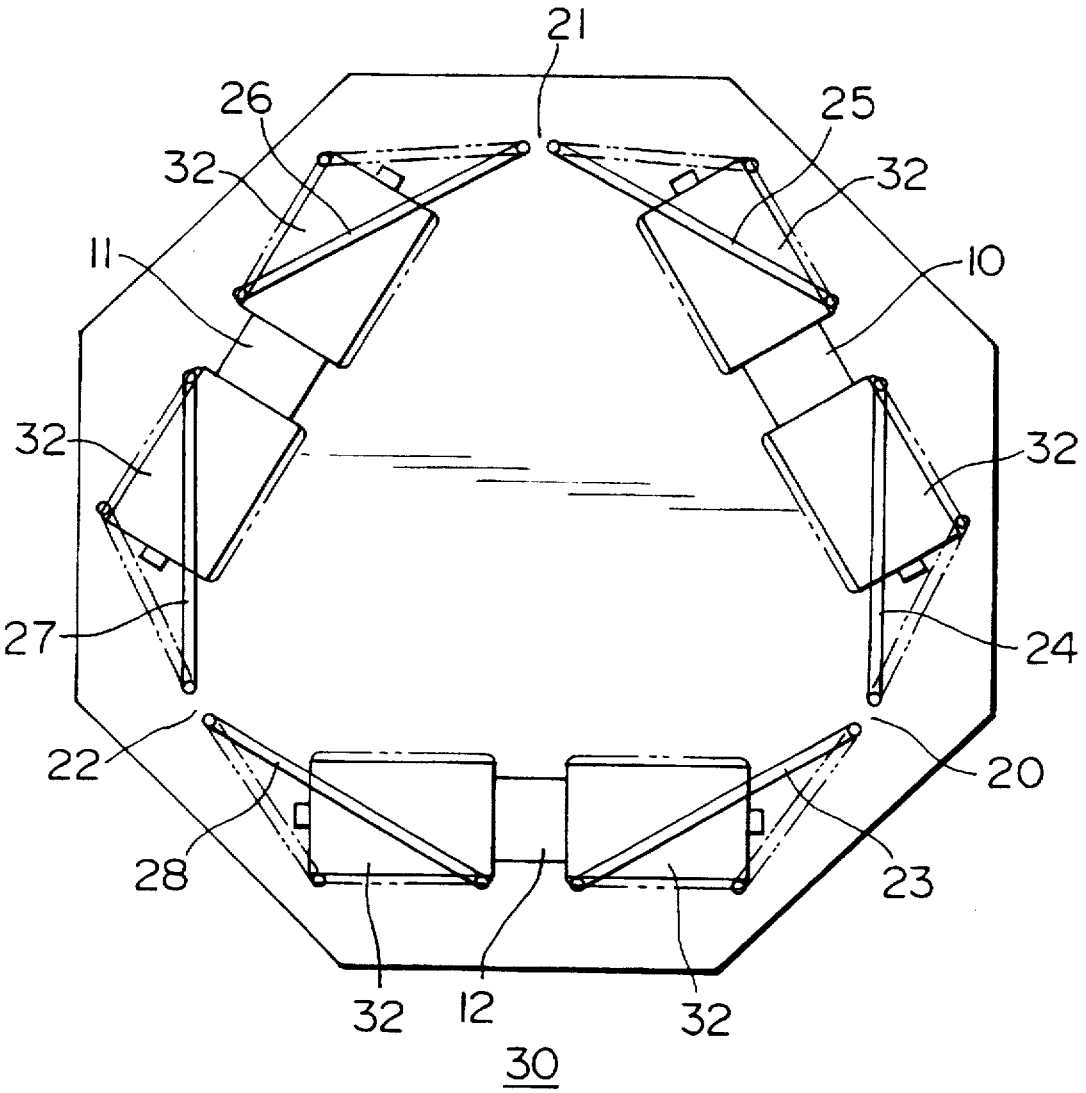
FIG. 2 is a rear elevation of the principal part of the embodied overhead travelling carriage main body.

Hoisting block 30 as shown in FIG. 2 is arranged on main body 4 and three sets of hoist members 10,11,12 are arranged on the block 30. Hoist members 10,11,12 are positioned along the three sides of an equilateral triangle and the center of that equilateral triangle is in alignment with the center of the hoisting block 30. It is not necessary for said equilateral triangle to be strictly equilateral and can be approximately equilateral. Cover 14 is a cover for the overhead travelling carriage main body 4.

Reference numeral 16 is a vertically movable table. Reference numeral 18 is a clamp provided with a hook or vacuum pad (not shown in the drawings) and guide holes 09 are unnecessary. Three suspension points 20,21,22, on top of the vertically movable table 16, are positioned at the three corners of an equilateral triangle having a center about the center of gravity of the vertically movable table 16 and have an angle of 120° between them. The center of the equilateral triangle formed by the hoist members 10, 11, 12 and the center of the equilateral triangle formed by the suspension points 20,21,22 are in vertical alignment but rotated 60° with respect to each other.

Cables 23–28 are attached to each of the suspension points 20–22 at two nearby points. It should be noted that the cables 23–28 can be attached to the exact suspension points 20–22. Cables 23–28 are comprised of ropes, belts or the like and the material is metal or sythetic resin.

The cable 23, attached to suspension point 20, is attached to hoist member 12 and cable 24 is attached to hoist member 10. Similarly, cable 25, attached to suspension point 21, is attached to hoist member 10 and cable 26 is attached to hoist member 11. Also, cable 27, attached to suspension point 22, is attached to hoist member 11 and cable 28 is attached to hoist member 12. As a result of this, each of cables 23–28 is not vertical but inclined with an angle between each of them. Thus one suspension point is supported by two hoist members and by two cables.

FIG. 2 shows the embodied hoist block 30. Two screw shaped hoisting drums 32,32 are arranged on each hoist member 10–12. FIG. 2 shows this state of the bottom surface of the hoist block 30 as seen from the suspension points 20–22. The solid line in the diagram shows when the vertically movable table 16 is in the lowest possible position and the dashed line shows when the vertically movable table 16 is in the highest possible position. Cables 23–28 start hoisting from the inside of the hoisting drum 32 and finish hoisting at the outside of the hoisting drum 32. As in FIG. 2, the hoisting position of the suspended members 23–28 changes from the inside of the hoist member 10–12 to the outside as the vertically movable table 16 rises.

Figure 3:
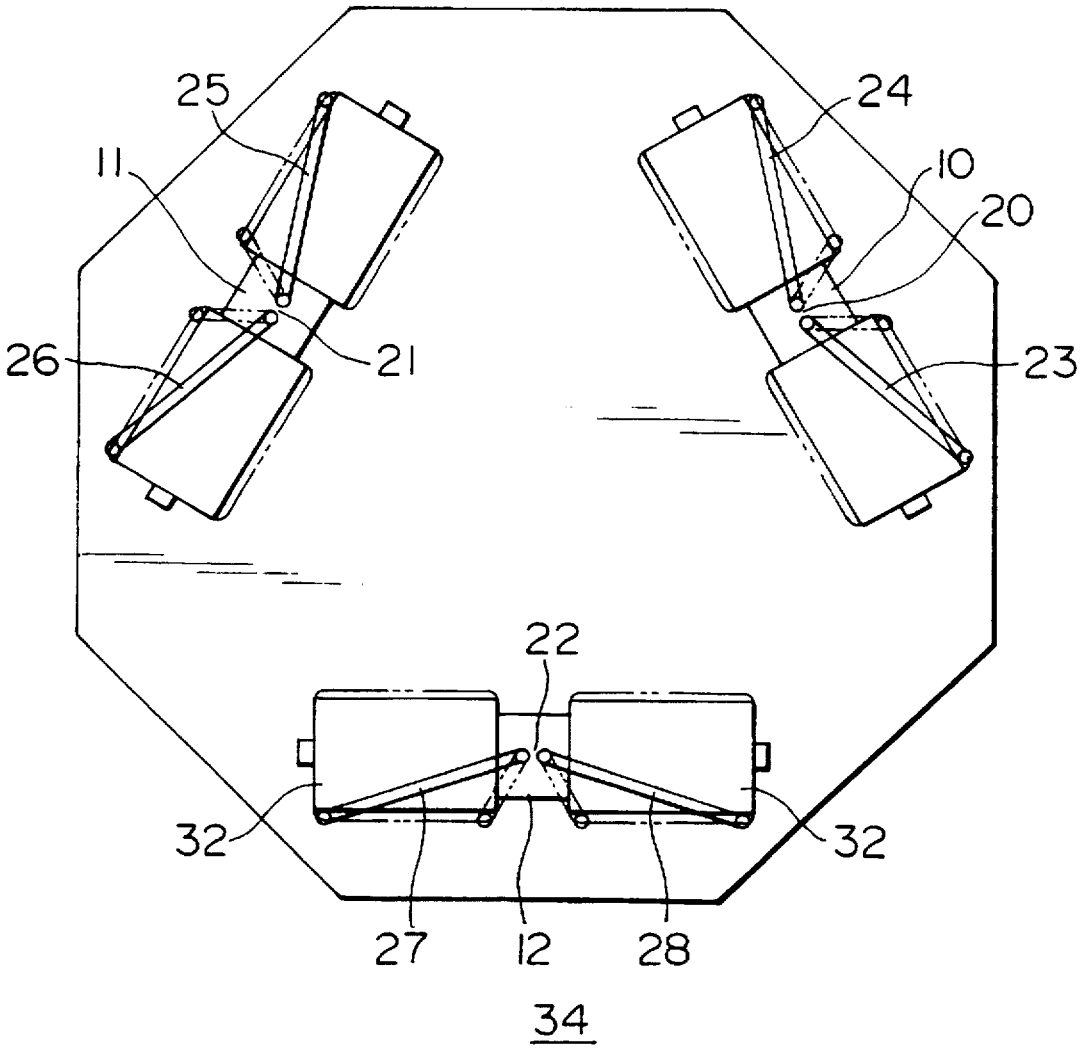
FIG. 3 is a rear elevation of principal part of a modification of an embodiment of the overhead travelling carriage main body.

A similar action can even be constructed using the hoisting block 34 of FIG. 3. On hoisting block 34, the positions of the hoist members 10–12 are changed with respect to the suspension points 20–22 so that the equilateral triangle formed by the suspension points 20–22 and the equilateral triangle formed by the center of the hoist members 10–12 are aligned. Furthermore, the cables 23–28 are made to hoist from the outside of the hoisting member 32 towards the inside. In both FIG. 2 and FIG. 3, the hoisting positions of the two cables 23/24, 25/26, 27/28 attached to the same suspension points seperate as the vertically movable table drops and come together as it rises.

Figure 4:
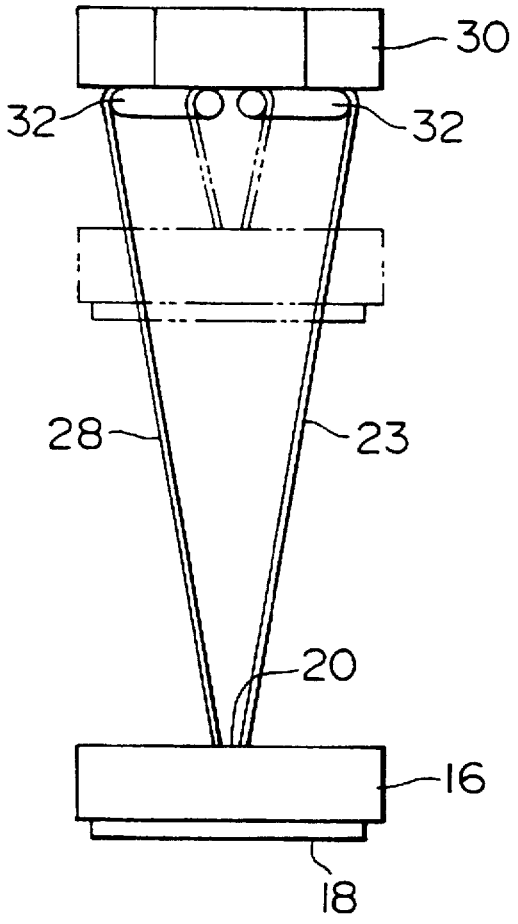
FIG. 4 is a front elevation showing the principal movements of the embodied overhead travelling carriage.
Figure 5:
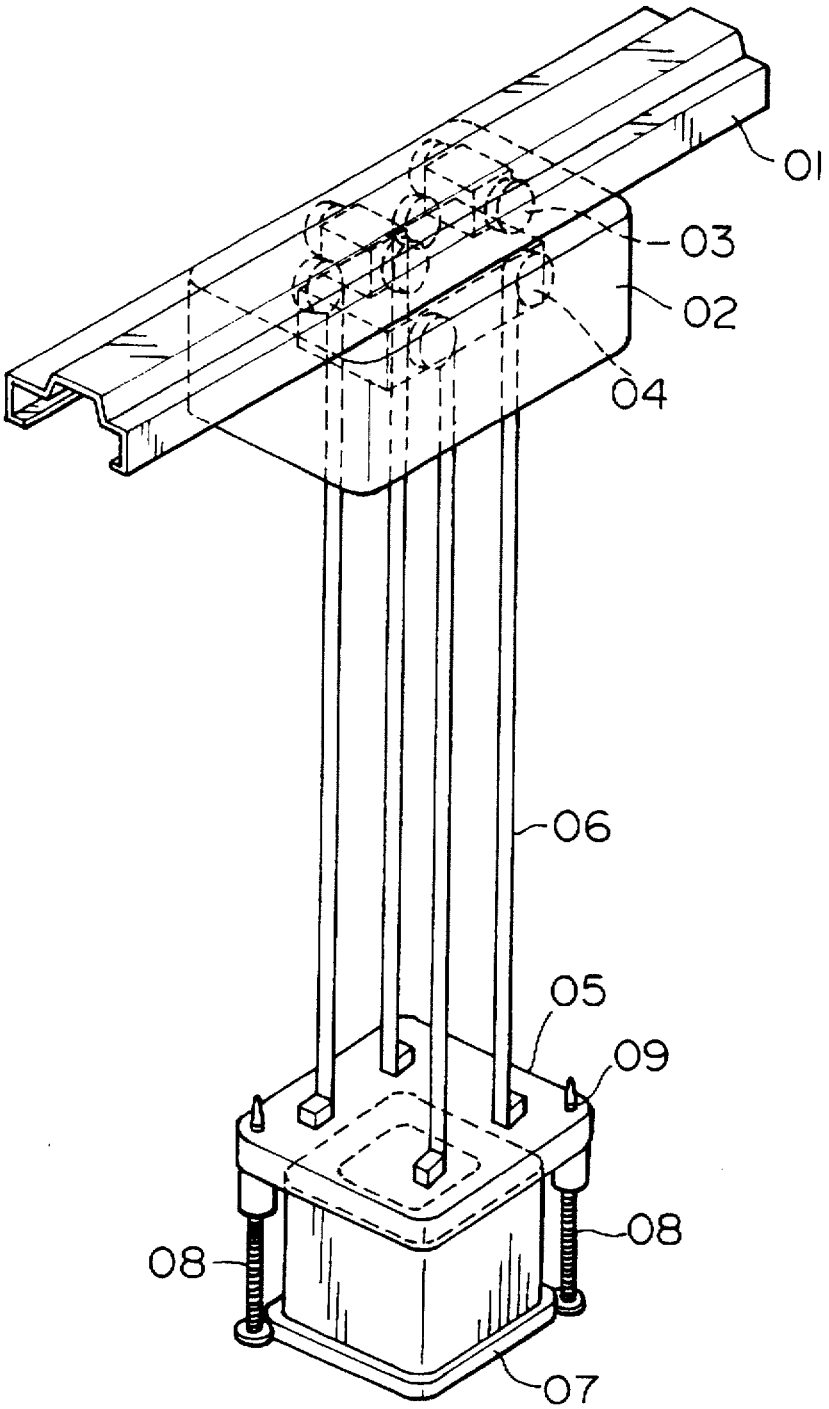
FIG. 5 is a perspective view of an overhead travelling carriage of the prior art.

The movement of the vertically movable table is shown in FIG. 4.

When the vertically movable table 16 lowers to the bottom end, the workpiece 07 is gripped by the clamp 18. As the vertically movable table 16 is suspended by six cables 23–28, there would be little slanting even supposing one of the cables broke and there would be no dropping of the workpiece 07. The vertically movable table 16 is suspended by six cables 23–28 and moreover the cables 23–28 are positioned at an incline with an angle formed between each of them. Due to this, there is little twisting or leaning of the vertically movable table.

For example, supposing the vertically movable table 16 tries to twist or oscillate, a large force is applied to one of the cables causing play in the other cables and as a consequence, thus oscillation and twisting are reliably prevented.

Furthermore, in association with this, the vertically movable table 16 can be raised and lowered at high speed. Also, as there is little oscillation and twisting, the precision of the vertically movable table 16 positioning is high and guide poles 08 and guide holes 09 become unnecessary.

The larger the angle between the two cables attached to one suspension point, the more stable the vertically movable table 16. Conversely, as this angle increases, the amount of torque necessary for the hoist member 10–12 increases. Therefore, the hoisting position of the cable 23–28 changes in association with the elevation of the vertically movable table 16 and the change of the aforementioned angle is regulated.

In short, when the vertically movable table 16 is at the lower side, the cables 23–28 hoist on the inside of the screw shaped hoisting drum 32, the hoisted cables 23–28 are stored in the grooves of the hoisting drum 32 and the hoisting position changes to the outside as the vertically movable table 16 rises. Consequently, the hoisting position of the cables 23–28 changes from the solid line to the broken line of FIG. 4 as the vertically movable table 16 rises and the change in the angle of between the two cables attached to the same suspension points is restricted.

In the present invention, as three suspension points are each supported by two cables and moreover as an angle is formed between each cable, the vertically movable table can be reliably supported. Due to this, oscillation and twisting of the vertically movable table can be reduced. And in association with this, as the vertically movable table is precisely lowered, there is no necessity for positioning guide poles. In addition, as there is little oscillation and twisting of the vertically movable table, the vertically movable table can be lowered at high speed. Furthermore, even if one cable should break, there is another cable at the same suspension point so there is little slanting of the vertically movable table.

Yet further, as the suspension points are arranged on the corners of an approximate equilateral triangle, this device is stable. Moreover, as each hoist member hoists two cables, hoisting of six cables can be carried out by three sets of the hoist members.

Yet still further, in association with the elevation of the vertically movable table as the hoisting position of the cables changes, the increase in torque necessary for hoisting during elevation is restricted and the oscillation and twisting of the vertically movable table can be reliably prevented by the increase in the angle between the cables during lowering.

What is claimed is:

1. An overhead traveling carriage having a main body movably engaged with a rail and a vertically movable table suspended from the main body, comprising:

three sets of hoist members mounted in the main body such that axes of said hoist members are positioned longitudinally along three sides of a triangle, each hoist member having a pair of screw shaped hoisting drums; and three pairs of suspending cables, wherein the movable table has, on its top, three suspension points positioned at three vertices of a triangle, and wherein proximal ends of cables of each pair of said suspending cables are attached to one of said suspension points and opposing ends, opposite said proximal ends, of cables of each pair of said suspending cables are each separately and directly led to a corresponding one of said hoist members and wound on a corresponding one of said screw shaped hoisting drums such that hoisting positions of each pair of suspending cables wound on said screw shaped hoisting drums separate from each other by the lowering of the movable table and approach to each other by the raising of the movable table.

2. An overhead travelling carriage as defined in claim 1, wherein said three suspension points are so arranged as to roughly form an equilateral triangle, and wherein two cables of each pair of said suspending cables are wound around hoisting drums of the same hoist member.

3. An overhead travelling carriage as defined in claim 1, wherein said three suspension points are so arranged as to roughly form an equilateral triangle, and wherein two cables of each pair of said suspending cables are wound around hoisting drums of different hoist members.

4. An overhead travelling carriage as defined in claim 3, wherein said pairs of suspending cables are wound around said drums, such that at a fully extended position, each cable of a pair is further apart from one another than when at a fully wound position.

5. An overhead travelling carriage as defined in claim 2, wherein said pairs of suspending cables are wound around said drums, such that at a fully extended position, each cable of a pair is further apart from one another than when at a fully wound position.

* * * * *